US007047866B2

(12) United States Patent
Fatemi et al.

(10) Patent No.: US 7,047,866 B2
(45) Date of Patent: May 23, 2006

(54) ELECTRICAL AND HYDRAULIC CONTROL SYSTEM FOR ATTACHMENT COUPLING SYSTEM

(75) Inventors: Ray S. Fatemi, Fairlawn, OH (US); Aaron L. Fockler, New Philadelphia, OH (US)

(73) Assignee: JRB Attachments, LLC, Cedar Rapids, IA (US)

( * ) Notice: Subject to any disclaimer, the term of this patent is extended or adjusted under 35 U.S.C. 154(b) by 0 days.

(21) Appl. No.: 10/770,316

(22) Filed: Feb. 2, 2004

(65) Prior Publication Data

US 2004/0244575 A1 Dec. 9, 2004

Related U.S. Application Data

(60) Provisional application No. 60/496,509, filed on Aug. 20, 2003, provisional application No. 60/443,942, filed on Jan. 31, 2003.

(51) Int. Cl.
*F15B 13/04* (2006.01)
*F01B 25/26* (2006.01)

(52) U.S. Cl. ..... 91/432; 91/420; 91/1

(58) Field of Classification Search ..... 91/432, 91/420, 1

See application file for complete search history.

(56) References Cited

U.S. PATENT DOCUMENTS

| | | | | |
|---|---|---|---|---|
| 4,850,790 | A * | 7/1989 | Johnson et al. | 91/420 |
| 4,953,592 | A * | 9/1990 | Takahashi et al. | 91/432 |
| 5,147,173 | A * | 9/1992 | Fauber et al. | 414/723 |
| 5,966,850 | A * | 10/1999 | Horton | 37/468 |
| 6,266,960 | B1 * | 7/2001 | Bibb et al. | 91/420 |
| 6,502,600 | B1 * | 1/2003 | Ennemark et al. | 91/432 |
| 2003/0204972 | A1 | 11/2003 | Cunningham et al. | |

FOREIGN PATENT DOCUMENTS

EP 1 318 242 A2 6/2003

* cited by examiner

*Primary Examiner*—Edward K. Look
*Assistant Examiner*—Michael Leslie
(74) *Attorney, Agent, or Firm*—Fay, Sharpe, Fagan, Minnich & McKee, LLP

(57) ABSTRACT

An attachment control system includes an electrical control system and hydraulic control system. The electrical control system interfaces with the hydraulic control system to ensure that attachment decoupling in response to operator electrical control can occur only when at least two different hydraulic threshold conditions are satisfied. In one example, decoupling is prevented unless the attachment is safely positioned (e.g., full curl) in response to operator manipulation of a joystick or other attachment positioning device. This can be detected, for example, when the hydraulic system has an overall operating pressure at or above a first threshold and a joystick pilot pressure at or above a second threshold.

31 Claims, 11 Drawing Sheets

ELECTRICAL AND HYDRAULIC CONTROL SYSTEM FOR ATTACHMENT COUPLING SYSTEM

CROSS-REFERENCE TO RELATED APPLICATIONS

This application claims benefit of the filing date of U.S. provisional patent application Ser. No. 60/443,942 filed Jan. 31, 2003 and U.S. provisional patent application Ser. No. 60/496,509 filed Aug. 20, 2003.

BACKGROUND

Construction attachment coupling systems and control systems for same are well known in the art. Safety is a primary concern for such systems and, in particular, such systems include means for preventing accidental decoupling of a bucket or other attachment as could lead to injury to those nearby. Another primary concern for such system is ease of use for operators. In many respects, safety and ease of use go hand-in-hand because a system that is easy for operators to use and understand is more likely to be used in a safe manner according to manufacturer instructions.

The present invention provides a new and improved electrical control system and/or a new and improved hydraulic control system for attachment coupling systems that enhances both safety and ease of use. While the electrical and hydraulic control systems are described herein as a combined system, each of these systems can be used independent of the other without departing from the overall scope and intent of the present invention.

SUMMARY

In accordance with a first aspect of the present development, a hydraulic control circuit for an attachment coupling system is disclosed. The control circuit comprising: an input flow path for receiving a supply of pressurized fluid; first and second actuator flow paths for supplying fluid to respective first and second input/output locations of a first hydraulic actuator; a return flow path for supplying pressurized fluid to a reservoir; a pilot pressure path adapted for connection to an attachment positioning device; a first control valve connected to said input flow path, said return flow path, and said first and second actuator flow paths, said first control valve selectively positionable in at least first and second states in response to first electrical input wherein: (i) in said first state, said first control valve-connects said input flow path to said first actuator flow path and connects said return flow path to said second actuator flow path; and, (ii) in said second state, said first control valve connects said input flow path to said second actuator flow path and connects said return flow path to said first actuator flow path; a first pressure sensor for sensing fluid pressure in said input path meeting or exceeding a first threshold; a second pressure sensor for sensing fluid pressure in said pilot pressure path meeting or exceeding a second threshold; wherein said first and second pressure sensors control said first electrical input to said first control valve to prevent a change of state of said first control valve depending upon fluid pressure in said input path and said pilot pressure path, respectively.

In accordance with another aspect of the present development, a control system for an attachment coupling system comprises: an electrical control system comprising: (i) a voltage input path; (ii) first and second pressure sensors; and, (iii) an electrical ground path; and, a hydraulic control system, wherein said hydraulic control system comprises: an input flow path for receiving a supply of pressurized fluid; first and second actuator flow paths for supplying fluid to respective first and second input/output locations of a first hydraulic actuator; a return flow path for supplying pressurized fluid to a reservoir; a pilot pressure path adapted to be connected to an attachment positioning device; a first control valve connected to said input flow path, said return flow path, and said first and second actuator flow paths, said first control valve selectively positionable in at least first and second states in response to first electrical input received from said electrical control system wherein: (i) in said first state, said first control valve connects said input flow path to said first actuator flow path and connects said return flow path to said second actuator flow path; and, (ii) in said second state, said first control valve connects said input flow path to said second actuator flow path and connects said return flow path to said first actuator flow path; wherein: said first pressure sensor senses pressure in said input flow path meeting or exceeding a first threshold; said second pressure sensor senses pressure in said pilot pressure path meeting or exceeding a second threshold; and, said first and second pressure sensors control transmission of said first electrical input from said electrical control system to said first control valve to prevent a change of state of said first control valve depending upon fluid pressure in said input path and said pilot pressure path, respectively.

In accordance with a further aspect, a hydraulic control circuit for an attachment coupling system is disclosed. The control circuit comprises: an input flow path for receiving a supply of pressurized fluid; first and second actuator flow paths for supplying fluid to respective first and second input/output locations of a first hydraulic actuator; a return flow path for supplying pressurized fluid to a reservoir; a pilot pressure path adapted for connection to an attachment positioning device; a first control valve connected to said input flow path, said return flow path, and said first and second actuator flow paths, said first control valve selectively positionable in at least first and second states in response to first electrical input wherein: (i) in said first state, said first control valve connects said input flow path to said first actuator flow path and connects said return flow path to said second actuator flow path; and, (ii) in said second state, said first control valve connects said input flow path to said second actuator flow path and connects said return flow path to said first actuator flow path; means for selectively preventing a change of state of said first control valve when fluid pressure in both said input path and said pilot pressure path is below a select threshold.

In accordance with another aspect of the present development, a hydraulic control circuit for an attachment coupling system comprises: an input flow path for receiving a supply of pressurized fluid; first and second actuator flow paths for supplying fluid to respective first and second input/output locations of a first hydraulic actuator; a return flow path for supplying pressurized fluid to a reservoir; a pilot pressure path adapted for connection to an attachment positioning device; a first control valve connected to said input flow path, said return flow path, and said first and second actuator flow paths, said first control valve selectively positionable in at least first and second states in response to first electrical input wherein: (i) in said first state, said first control valve connects said input flow path to said first actuator flow path and connects said return flow path to said second actuator flow path; and, (ii) in said second state, said first control valve connects said input flow path to said second actuator flow path and connects said return flow path to said first actuator flow path; wherein said first electrical input to said first control valve is interrupted when pressure in at least one of said input flow path and said pilot pressure path does not satisfy a select pressure condition.

The present development also relates to a method for controlling an attachment coupling system. The method comprises: pressurizing a locking mechanism with hydraulic fluid in a first orientation to lock an attachment locking mechanism; and, pressurizing said locking mechanism with hydraulic fluid in a second orientation to unlock an attachment locking mechanism, wherein said step of pressurizing said locking mechanism with hydraulic fluid in a second orientation is performed only after at least two separate hydraulic pressure threshold conditions have been satisfied.

BRIEF DESCRIPTION OF THE DRAWINGS

The invention comprises various components and arrangements of components, and comprises various steps and arrangements of steps, preferred embodiments of which are illustrated in the accompanying drawings that form a part hereof and wherein.

DETAILED DESCRIPTION

Figure 1A:
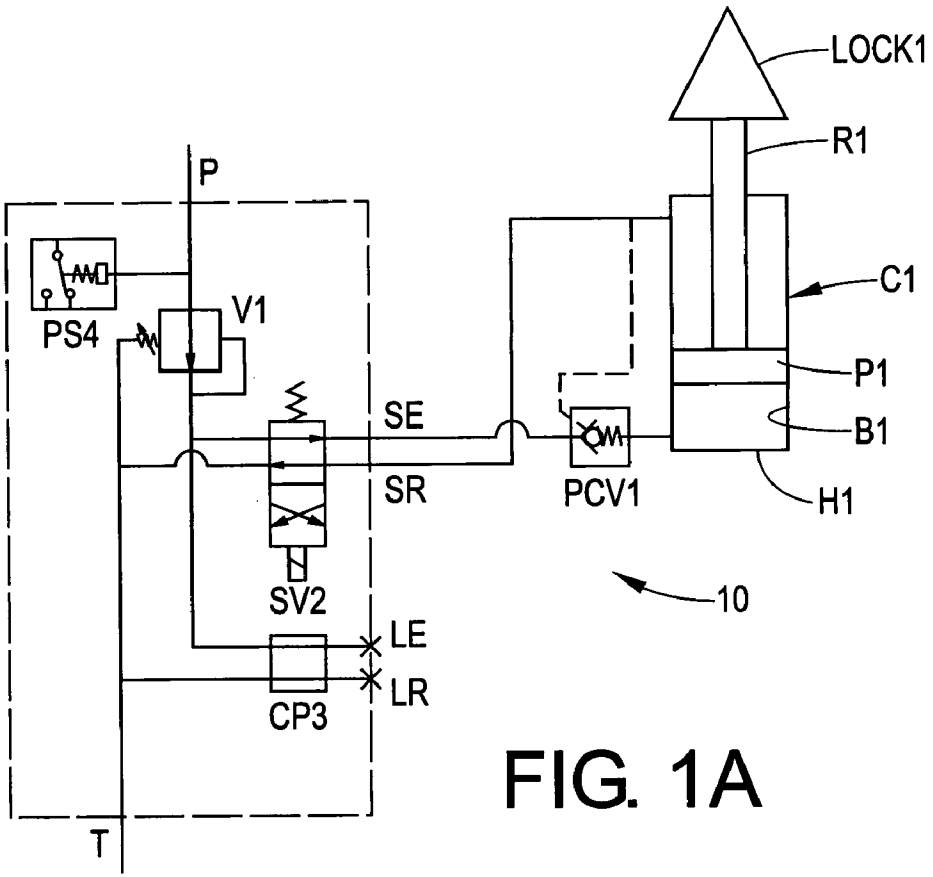
FIG. 1A is a schematic diagram of a hydraulic circuit for controlling a single hydraulic cylinder or other hydraulic actuator in accordance with the present invention.
Figure 1B:
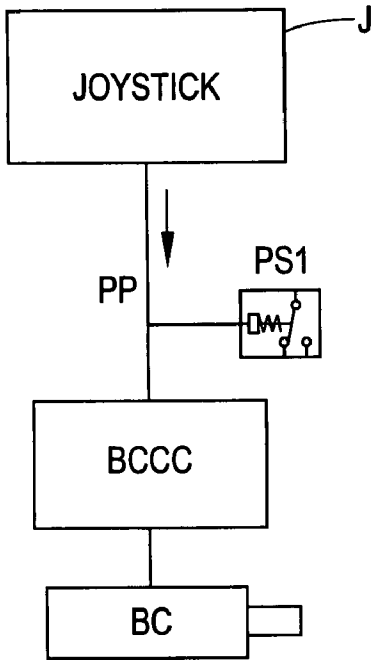
FIG. 1B is a schematic diagram of a joystick pilot pressure control circuit.
Figure 1C:
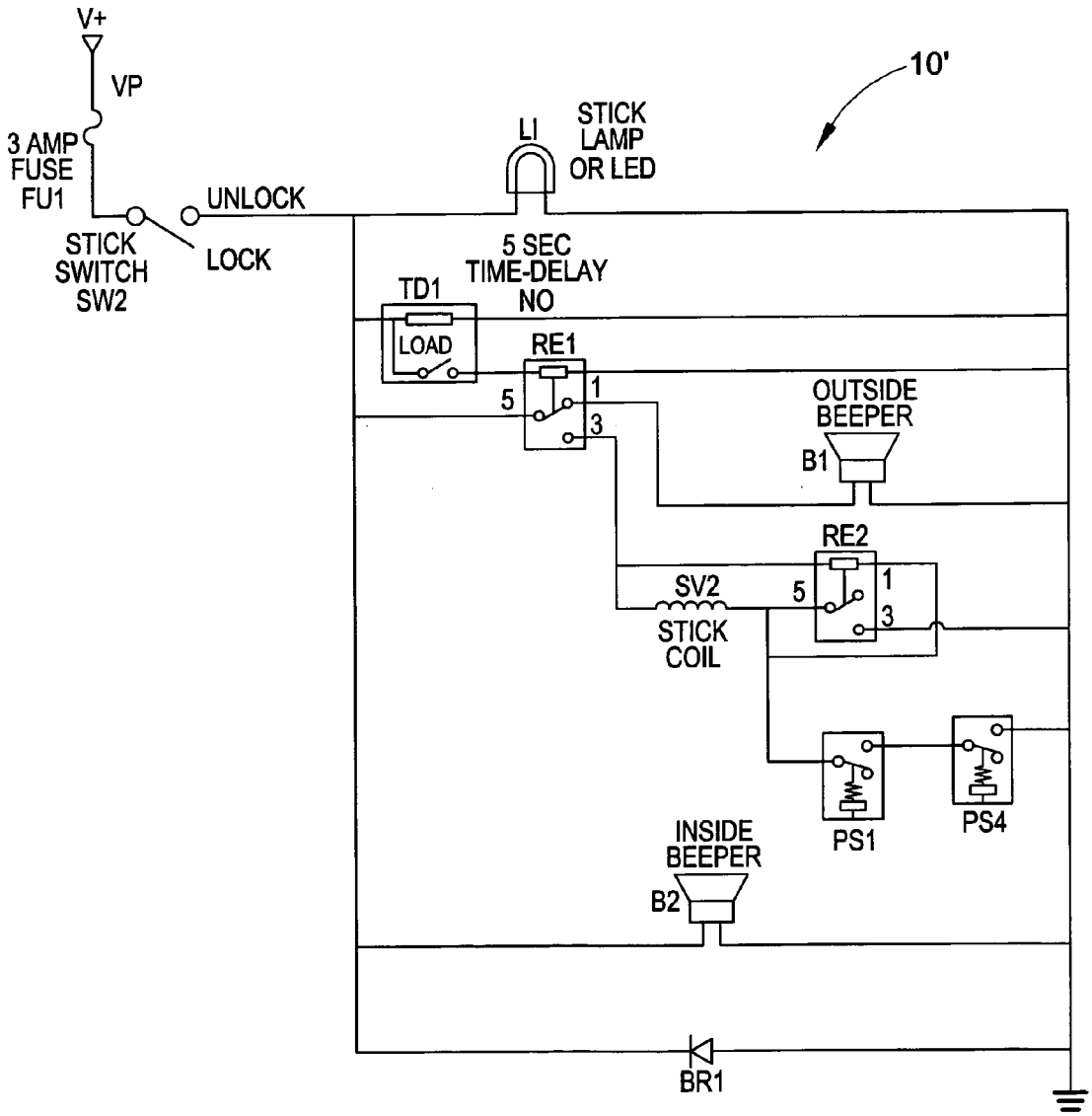
FIG. 1C is a schematic diagram of an electrical circuit for controlling a single-actuator hydraulic circuit (such as that shown in FIG. 1A) in accordance with the present invention.

Referring now to FIGS. 1A–1C of the drawings, a hydraulic circuit 10 for controlling a single hydraulic actuator such as a motor or cylinder C1 in accordance with the present invention is shown. The cylinder C1, itself, is conventional in all respects and can be provided as a part of or separate from the circuit 10. The cylinder C1 comprises a housing H1 defining a bore B1, and a piston P1 is closely and slidably received in the bore B1. A rod R1 is connected to and moves together with the piston P1, and the position of the piston P1 in the bore B1 is controlled by variation of the hydraulic pressure on opposite sides of the piston P1 in the bore B1. The circuit 10 (not including the cylinder C1) can be defined by discrete components connected by hydraulic lines but is preferably defined as a block or manifold M including the various flow paths drilled or otherwise defined therein and including valve cartridges and the like connected thereto.

First and second hydraulic actuator fluid flow paths (such as drilled flow paths, hydraulic hoses/lines and/or any other suitable flow paths or conduits) SR,SE are connected to output/input fittings of the cylinder housing H1 in fluid communication with the bore B1 and communicate hydraulic fluid into and out of the bore B1 on opposite sides of the piston P1 to control the difference in pressure on opposite sides of the piston P1 and, thus, the position of the piston P1 in the bore B1. In a typical arrangement, "extension" of the piston P1 so that the rod R1 extends farther out of the housing corresponds to a "locked" condition of the coupling system; retraction of the piston P1 and rod R1 corresponds to an "unlocked" condition of the coupling system.

A pilot check valve PCV1 is included and is operatively connected between to the paths SR,SE to prevent flow of fluid out of the bore B1 via path SE unless the path SR is pressurized above a select pilot check threshold. This arrangement prevents the piston P1 and rod R1 from retracting unless the path SR is actively pressurized, i.e., fluid cannot flow from the bore B1 via path SE as required to retract the piston P1 and rod R1 unless the path SR is positively pressurized to open the pilot check valve PCV1 to reduce the likelihood of accidental retraction of the piston P1 and rod R1 upon the path SE being unexpectedly opened due to a broken hose or the like.

Hydraulic fluid is supplied continuously to the circuit 10 under pressure via pressure input path P from a pump (not shown) that draws from the reservoir or tank (not shown). Fluid is returned to the reservoir/tank via return path T. At least one joystick J or other actuator positioning device (e.g., levers, foot pedals, etc.) is used by an operator to control fluid flow to an attachment positioning actuator or cylinder (also referred to as a bucket cylinder) BC used to extend (roll-back) and curl a bucket or otherwise maneuver an attachment that is operative coupled to the excavator, backhoe or other machine on which circuit 10 is employed. As is generally known, the control device J outputs a varying pilot pressure of hydraulic fluid in a pilot pressure path PP depending upon its position as maneuvered by an operator to control both direction and speed of motion of the bucket cylinder BC. This pilot pressure in path PP is input to a bucket cylinder control circuit BCCC that drives the bucket cylinder BC. As is also known to those of ordinary skill in the art, extension of the bucket cylinder causes curling of the bucket or other attachment, while retraction of the bucket cylinder causes extension or roll-back of the bucket or other attachment. The pump typically pressurizes the pressure input path P to an input pressure of 4000–6000 pounds per square inch (psi). A pressure control valve V1 receives the path P as input and outputs hydraulic fluid at a select operating pressure, preferably in the range of about 3000 psi –3500 psi (but this can vary) in the path SE.

The paths SR,SE are each in communication with a first electro-mechanical fluid flow control valve such as solenoid valve SV2. In a normal, non-actuated condition, the solenoid valve SV2 connects the path SR to the return path T and connects the path SE to the output of pressure reducing valve V1. As such, in this normal state, the hydraulic fluid output via valve V1 at a select operating pressure is communicated through solenoid valve SV2 and path SE to the extend side of the piston P1. At the same time, the path SR is in communication with the return path T via solenoid valve SV2 so that the retract side of the piston P1 can exhaust to the tank. Therefore, in this state, the pressure difference in paths SR,SE will result in the extension of the piston P1 and rod R1 which, as noted, typically corresponds to a "locked" condition for an associated locking mechanism LOCK1 that is operably coupled to or otherwise controlled by position of rod R1. This continuous pressurizing of the path SE is a safety consideration owing to the fact that the coupling system lock LOCK1 actuated by the cylinder C1 is configured to be engaged (and thus operatively retain a bucket or other attachment) when the piston P1 and rod R1 are extended.

Retraction of the piston P1 to disengage the associated lock LOCK1 as required to de-couple a bucket or other attachment requires sufficient pressurization of the path SR to move the piston P1 and also to open the pilot check valve PCV1 to allow exhaust flow from the bore B1 in path SE. In general, this state is established by energizing a coil of the solenoid valve SV2 so that the solenoid valve is actuated, i.e., the spool thereof is "shifted," to establish cross-flow between the paths SR and SE which, in turn, causes the operating flow output from the pressure control valve V1 to be directed to the path SR instead of the path SE and causes the path SE to be connected in fluid communication to the return path T. This actuated or shifted or energized state of the solenoid valve SV2 leads to retraction of the piston P1 and rod R1 and unlocking of an associated lock connected thereto as required for attachment decoupling operations.

Because retraction of the piston P1 and rod R1 connected thereto results in retraction or other disengagement of a lock LOCK1 operatively connected to the rod R1 which, in turn, allows for de-coupling of an associated attachment such as a bucket, blade or the like, it is important to ensure that the path SR be pressurized for retraction of the piston P1 and opening of the pilot check valve PCV1 and that the path SE flow to the reservoir tank via return path T only upon at least both of the following two conditions being met:

(i) the pressure in the input path P must be over a select maximum "trigger" value for a sustained period, wherein the trigger value is set to a select percentage of the "over-relief" pressure that occurs when the bucket or other attachment is physically unable to pivot further in at least one direction under maximum available hydraulic pressure (i.e., the attachment is in either the full-curl or full-extend position); and, (ii) predetermined and sustained operator manipulation of a control device (typically a joystick) J in a manner that indicates the operator has intentionally moved (or attempted to move) the bucket or other attachment to the required attachment decoupling position (i.e., full-curl or full-extend).

Satisfaction of the first condition (i) of a select trigger pressure indicates that the bucket or other associated attachment to be decoupled is likely in a full-curl or full-extend (roll-back) position as required for safe decoupling. Satisfaction of the second condition (ii) indicates that the operator has intentionally moved the bucket or other attachment to the required decoupling position (full-curl or full-extend as appropriate) and that the satisfaction of the first condition (i.e., the select trigger pressure) has not resulted from another condition as could occur during certain operative conditions, e.g., digging in a rocky area or from use of other segments of the excavator or other machine. Thus, with both conditions (i) and (ii) satisfied, it is known that the attachment has been moved intentionally to the required decoupling position, which can be either full-curl or full-extend by extending and retracting the bucket cylinder, respectively.

To determine if the first condition is satisfied, i.e., (i) presence of the select trigger pressure in input path P, the circuit 10 comprises a first pressure switch PS4 in communication with the input path P. When the pressure in input path P meets or exceeds the select trigger pressure the first pressure switch PS4 is actuated. In the illustrated embodiment, the first pressure switch PS4 is a normally open switch and closes when the pressure in input path P reaches or exceeds the select trigger pressure. In one embodiment, the trigger is set to 85%–90% of the over-relief pressure for a particular machine. The pressure magnitude required to actuate first pressure switch PS4 can be fixed or adjustable.

To determine if the second condition (ii) is satisfied, i.e., to determine if there exists predetermined and sustained operator manipulation of a joystick J or other control device in a manner that indicates the operator has intentionally moved (or attempted to move) the bucket or other attachment to the required decoupling position, a second pressure switch PS1 is provided as part of circuit 10 (see FIG. 1B that shows a pilot pressure control circuit portion of circuit 10) and is connected in fluid communication with a pilot pressure path PP output by joystick J. When the joystick J is manipulated to either the full-curl or full-extend position, the pressure in the pilot pressure path PP output by joystick is sufficient to actuate the switch PS1. In the illustrated embodiment, the second pressure switch PS1 is a normally open switch that closes when the hydraulic pressure in pilot path PP exceeds a select threshold. The pressure magnitude required to actuate second pressure switch PS1 can be fixed or adjustable.

The first and second pressure switches PS4,PS1 form a part of both the hydraulic circuit 10 and the electrical control circuit 10' (see FIG. 1C) that is suitable for controlling the hydraulic circuit 10, in particular the solenoid valve SV2 thereof, for attachment coupling/de-coupling operations. In this manner, the state of the switches PS4,PS1 is used to control actuation of the solenoid valve SV2 of hydraulic circuit 10. The electrical circuit 10' is constructed using hard-wired components and/or using a printed circuit. The components can be electromechanical devices or solid-state devices, microprocessors and/or any other suitable and convenient means including software and the like.

The circuit 10' of FIG. 1C is intended to ensure that the rod and piston R1,P1 of cylinder C1 are held in the retracted position after being retracted so that the lock LOCK1 controlled thereby remains "unlocked" for a sufficient time to allow for decoupling operations. As shown in FIG. 1C, a DC operating voltage V+ is supplied by way of a voltage input path VP to a switch SW2 located in the operator cab. The switch SW2 is a simple toggle switch or can be a more advanced switching system including a microprocessor or the like that allows for sophisticated control of switch activation and associated features. For example, use of a microprocessor allows for use of electronic push-buttons that must be pressed and held for sufficient duration (e.g. 1–3 seconds) before closing of switch SW2 to prevent accidental actuation. In one preferred embodiment, the switch SW2 is a safety toggle switch that requires two-stage manipulation by an operator to prevent opening and/or closing by simple bumping or the like, e.g., a detent-toggle switch that requires upward pulling on the switch lever combined with pivoting of the lever. A key lock-out can also be provided to prevent movement of switch SW2 absent use of a mating key.

When the switch SW2 is opened, the coil of the solenoid valve SV2 is de-energized due to the open circuit relative to voltage source V+. When the switch SW2 is closed, current flows through an indicator lamp or LED or the like L1 located in the operator's cab so that the operator receives a visual indication that the switch SW2 is closed. Closing of the switch SW2 also results in current flow through an audible buzzer/beeper B2 located inside the operator's cab so that the operator receives an audible indication that the switch SW2 is closed.

Furthermore, when the switch SW2 is closed, current flows to a timer TD1 and through relay RE1 to a beeper/buzzer B1 located outside the operator's cab to warn workers and others that the switch SW2 is closed (i.e., that a de-coupling operation is being carried out).

After a select delay (e.g., 5 sec.) according to the parameters of timer TD1, the timer TD1 latches so that a switching current also flows to relay RE1 and causes relay to switch from a first conductive state (as shown with terminals 5-1 connected) to a second conductive state (in which terminals 5-3 are connected). In the second conductive state of relay RE1, the outside beeper B1 is de-energized. If, at the same time, the first and second hydraulic pressure switches PS4, PS1 are closed (i.e., conditions (i) and (ii) above are satisfied), the circuit between the voltage source V+ and ground is complete and the coil of solenoid valve SV2 is energized to actuate or shift the solenoid valve SV2 as described above in relation to FIG. 1A so that cross-flow is established in paths SR,SE causing retraction of piston P1. This current flow through coil of solenoid valve SV2 provides a switching current to relay RE2 that causes relay RE2 to switch from a first conductive state, with terminals 5-1 connected, to a second conductive state, with terminals 5-3 connected. When the relay RE2 is in its second conductive state, the pressure switches PS1,PS4 are bypassed so that if either or both of these switches opens, the coil of valve SV2 remains energized. This is required to ensure that the rod and piston R1,P1 of cylinder C1 stay retracted while an operator maneuvers the coupling device in an effort to couple to or decouple from an attachment even though conditions (i) and/or (ii) above would become unsatisfied during this coupling/decoupling procedure. When the operator opens switch SW2, current flow through coil of valve SV2 ceases so that the rod and piston R1,P1 of cylinder C1 are extended and so that relay RE2 resets to its normal first conductive state as shown in FIG. 1C. When relay RE2 resets, pressure switches PS1,PS4 are once again placed back into the circuit path between coil of valve SV2 and ground. The diode BR1 is provided as a circuit protection device to prevent damage to the lamp L1 and other circuit components.

The first and second pressure switches PS4,PS1 form a part of both the hydraulic circuit 10 and the electrical control circuit 10'. The state of the switches PS4,PS1 is used to control initial actuation of the solenoid valve SV2 but are then effectively removed from the circuit by relay RE2 to allow for coupling/decoupling operations. The electrical circuit 10' is constructed using hard-wired components and/or using a printed circuit. The components can be electromechanical devices or solid-state devices, microprocessors and/or any other suitable and convenient means and combinations of same.

Those of ordinary skill in the art will recognize from the foregoing that the sound of the outside warning buzzer/beeper B1 combined with the delay of, e.g., 5 sec., provides those located near the excavator or other machine with sufficient warning of attachment decoupling prior to the coil of the solenoid valve SV2 being energized to initiate decoupling operations.

Figure 2A:
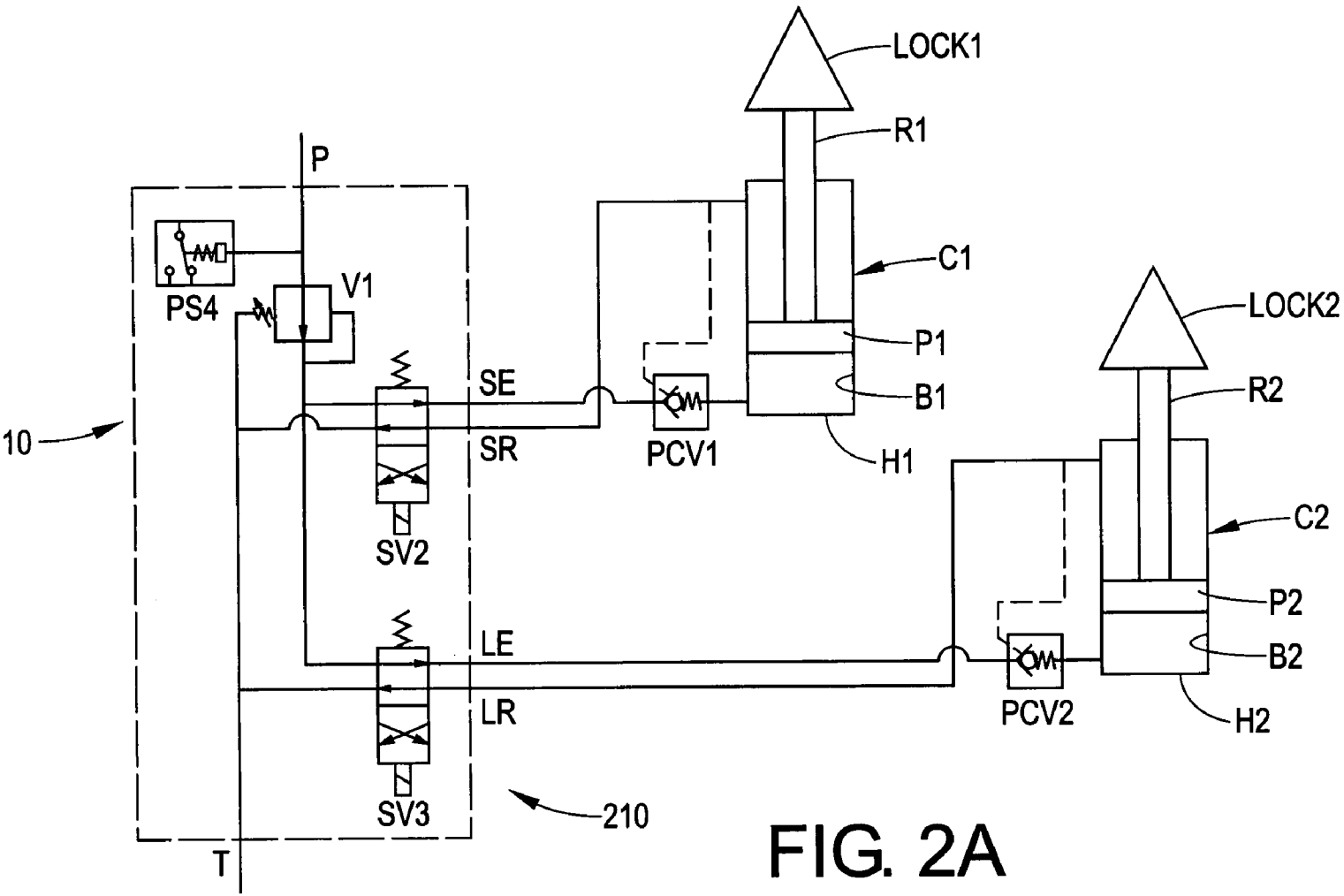
FIG. 2A is a schematic diagram of a hydraulic circuit for controlling a two-actuator hydraulic circuit in accordance with the present invention.

FIG. 2A illustrates the hydraulic circuit 10 shown in FIG. 1A and further illustrates a secondary hydraulic circuit operably connected thereto so as to define a hydraulic circuit 210 suitable for controlling first and second hydraulic actuators such as, e.g., cylinders C1,C2, in accordance with the present invention. The cylinders C1,C2 can be provided as a part of the circuit 210, but are typically provided as separate components.

Further discussion of the circuit portion 10 for controlling cylinder C1 is not provided here (see discussion of circuit 10 above in relation to FIG. 1A). As described below, other portions of circuit 210 control the cylinder C2, and relevant portions of the above disclosure relating to the circuit 10 also apply to the circuit 210 unless otherwise noted. In a typical arrangement, the rod R1 of the first cylinder C1 is operably coupled to and controls a first pin locking/capturing mechanism LOCK1 of an attachment coupling system, while the rod R2 of the second cylinder C2 is operatively coupled to and controls a second pin locking/capturing mechanism LOCK2 of the attachment coupling system. The first pin locking mechanism is typically used to capture the attachment to an arm or "dipper" stick while the second pin locking mechanism is used to capture the attachment to a control link. As such, the first pin locking mechanism LOCK1 is typically the first to be locked during attachment coupling operations and the last to be unlocked during attachment de-coupling operations.

The cylinders C1,C2 are typically structurally similar or identical and, thus, the cylinder C2 comprises a housing H2, bore B2, piston P2 and rod R2. As discussed above in relation to the cylinder C1, extension of piston P2 and rod R2 so that the rod extends out of the housing H2 a greater amount typically corresponds to a "locked" condition for the second locking mechanism connected thereto; retraction of the piston P2 and rod R2 so that the length of rod R2 extending out of the cylinder C2 is shortened corresponds to an "unlocked" condition of the second locking mechanism connected thereto.

In addition to the circuit portion 10, the circuit 210 further comprises a second pilot check valve PCV2 and a second electro-mechanical fluid flow control valve such as a solenoid valve SV3. Hydraulic actuator fluid flow paths (such as drilled flow paths, hydraulic hoses/lines and/or any other suitable flow paths of conduits) LR,LE are connected to the cylinder input/output fittings of housing H2 in fluid communication with the bore B2 and communicate hydraulic fluid into and out of the bore B2 on opposite sides of the piston P2 to control the difference in pressure on opposite sides of the piston P2 and, thus, the position of the piston P2 in the bore B2.

A pilot check valve PCV2 is included and is operatively connected between to the paths LR,LE to prevent flow of fluid out of the bore B2 via path LE unless the path LR is pressurized above a select pilot check threshold. This arrangement prevents the piston P2 and rod R2 from retracting unless the path LR is actively pressurized, i.e., fluid cannot flow from the bore B2 via path LE as required to retract the piston P2 and rod R2 unless the path LR is positively pressurized to open the pilot check valve PCV2 to reduce the likelihood of accidental retraction of the piston and rod upon the path LE being unexpectedly opened due to a broken hose or the like.

As noted above, hydraulic fluid is supplied continuously to the circuit 210 under pressure via pressure input path P and a pressure control valve V1 receives the path P as input and outputs hydraulic fluid at a select operating pressure, in the range of about 3000 psi –3500 psi or any other desired pressure range. Like path SE, the path LE is also in communication with the output of the valve V1 to receive the operating flow therefrom.

The paths LR,LE are each in communication with the solenoid valve SV3. In a normal, non-actuated or non-energized condition, the solenoid valve SV3 connects the path LR to the return path T and connects the path LE to the output of pressure reducing valve V1. As such, in this state, the hydraulic fluid output via valve V1 at a select operating pressure is communicated through solenoid valve SV3 and path LE to the extend side of the piston P2. At the same time, the path SR is in communication with the return path T via solenoid valve SV3 so that the retract side of the piston P2 can exhaust to the reservoir tank via path T. In this state, the pressure difference in paths LR,LE will result in the extension of the piston P2 and rod R2 which, as noted, typically corresponds to a "locked" condition for an associated locking mechanism that is operably coupled to or otherwise controlled by position of rod. This continuous pressurizing of the path LE is another safety consideration owing to the fact that the coupling system lock actuated by the cylinder C2 is configured to be engaged (and thus operatively retain a bucket or other attachment) when the piston P2 and rod R2 are extended.

Retraction of the piston P2 to disengage the associated lock as required to release a bucket or other attachment requires sufficient pressurization of the path LR to move the piston P2 and also to open the second pilot check valve PCV2 to allow exhaust flow from the bore B2 in path LE. In general, this state is established by energizing the solenoid valve SV3 which, when energized or actuated, i.e., when the spool thereof is "shifted," establishes cross-flow between the paths LR and LE so that the operating flow output from the pressure control valve V1 is directed to the path LR instead of the path LE and so that the path LE is connected in fluid communication to the return path T. This, in turn, leads to retraction of the piston P2 and rod R2 and unlocking of an associated lock connected thereto as required for attachment decoupling operations.

Because retraction of the piston P2 and rod R2 results in retraction or other opening of a lock operatively connected to the rod which, in turn, allows for de-coupling of an associated attachment such as a bucket, blade or the like, it is important to ensure that the path LR is pressurized for retraction of the piston P2 and opening of the pilot check valve PCV2 and that the path LE flows to the reservoir tank via return path T only upon both of the following two conditions being met for the reasons discussed above:

(i) the pressure in the input path P must be over a select maximum "trigger" value for a sustained period, wherein the trigger value is a select percentage of the over-relief pressure that occurs when the bucket or other attachment is physically unable to pivot further in at least one direction under maximum available hydraulic pressure (i.e., the attachment is in either the full-curl or full-extend position); and, (ii) predetermined and sustained operator manipulation of a control device (typically a joystick) J in a manner that indicates the operator has intentionally moved (or attempted to move) the bucket or other attachment to the required attachment decoupling position (i.e., full-curl or full-extend).

The pressure switches PS4,PS1 (see also FIG. 1C) form part of the circuit 210 and operate as described above to determine if these two conditions are satisfied.

Figure 2B:
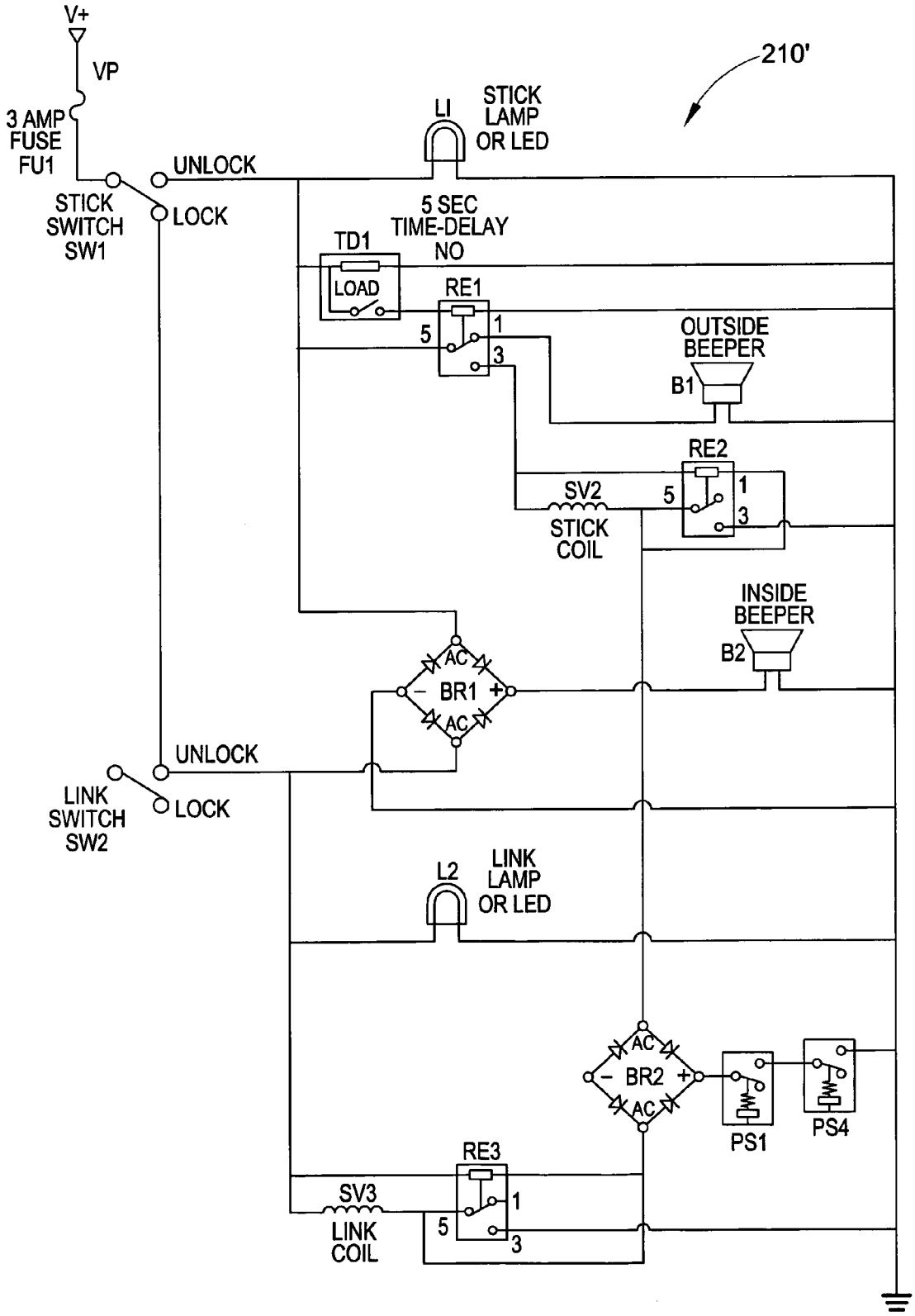
FIG. 2B is a schematic diagram of an electrical circuit for controlling a two-actuator hydraulic circuit in accordance with the present invention.

FIG. 2B illustrates an electronic control circuit 210' also suitable for controlling the hydraulic circuit 210. The first and second pressure switches PS4,PS1 form a part of both the hydraulic circuit 210 and the electrical control circuit 210'. The state of the switches PS4,PS1 is used to control actuation of the solenoid valves SV2,SV3 of hydraulic circuit 210. The electrical circuit 210' is constructed using hard-wired components and/or using a printed circuit. The components can be electromechanical devices or solid-state devices, microprocessors and/or any other suitable and convenient means.

As shown in FIG. 2B, DC operating voltage V+ is supplied to a switch SW1 located in the operator cab via path VP. The switch SW1 is preferably a double-pole, single-throw switch that is normally in the "lock" position. In this "lock" position, the switch SW1 completes a circuit between the voltage source V+ and the switch SW2. When the switch SW1 is moved to the "unlock" position, it opens the circuit between the voltage source V+ and the switch SW2. Consequently, it is impossible for the coils both solenoid valves SV2,SV3 of hydraulic circuit 210 to be energized for unlocking operations at the same time. This is a safety feature that prevents the first and second locks controlled by the respective first and second cylinders C1,C2 from being unlocked simultaneously. The switches SW1,SW2 can be simple toggle-type switches or can be a more advanced switching system including a microprocessor or the like that allows for sophisticated control of switch activation and associated features as described above in relation to switch SW2 of FIG. 1A.

The switch SW1 is normally in the "lock" position so that when the switch SW2 is closed by an operator to initiate decoupling operations, current flows through an indicator lamp or LED or the like L2 located in the operator's cab so that the operator receives a visual indication that the switch SW2 is closed. Closing of the switch SW2 also results in current flow through an audible buzzer/beeper B2 located inside the operator's cab so that the operator receives an audible indication that the switch SW2 is closed.

If the pressure switches PS4,PS1 are closed (i.e., if conditions (i) and (ii) above are met) closing of switch SW2 results in current flow through the coil of solenoid valve SV3 to energize the solenoid valve SV3 and actuate or shift same. This results in retraction of piston P2 and rod R2 of cylinder C2 owing to the establishment of cross-flow in the paths LE,LR as described above. Current flow through coil of valve SV3 acts as a switching current to relay RE3 and causes same to switch from a first, normal conductive state as shown, where a current path between terminals 5-1 is provided, to a second conductive state where a current path between terminals 5-3 is provided. In the second conductive state, relay RE3 provides a bypass around pressure switches PS1,PS4 for current flow through coil of valve SV3 to ground. As such, when relay RE3 is in its second conductive state, pressure switches PS1,PS4 are effectively removed from the circuit 210' and do not affect current flow even if one or both subsequently open as required for coupling/decoupling operations. Valve SV3 will be actuated to maintain rod and piston R2,P2 of cylinder C2 in a retracted condition until an operator opens switch SW2 or moves switch SW1 to "unlock." This ensures that a lock controlled by cylinder C2 will remain unlocked for a sufficient time as needed to complete coupling/decoupling operations.

After an operator has completed a decoupling operation with respect to a lock controlled by the cylinder C2 by closing switch SW2 as just described, the operator will desire to complete a second decoupling operation with respect to a lock controlled by the cylinder C1. As such, the operator will actuate switch SW1 to switch same to the "unlock" position. This results in the circuit to switch SW2 and coil of solenoid SW3 being opened. Current through coil of valve SV3 is interrupted and relay RE3 resets to its first conductive state. At the same time, current flows to a visual indicator L1 such as a lamp or LED or the like to indicate that the switch SW1 has been moved to the "unlock" position. When the switch SW1 is set to "unlock" current flows via bridge BR1 to inside beeper B2 to provide an audible signal to an operator in the machine cab. Also, with switch SW1 set to "unlock" current flows to the timer TD1 and through relay RE1 to a beeper/buzzer B1 located outside the operator's cab to warn workers and others that an attachment de-coupling operation is being carried out.

After a select delay (e.g., 5 sec.) the timer TD1 latches so that a switching current also flows to relay RE1 and causes relay to switch from a first conductive state (as shown with terminals 5-1 connected) to a second conductive state (in which terminals 5-3 are connected). In the second conductive state of relay RE1, the outside beeper B1 is de-energized. If, at the same time, the first and second hydraulic pressure switches PS4,PS1 are closed (i.e., conditions (i) and (ii) above are satisfied), the circuit between the voltage source V+ and ground is complete and the coil of solenoid valve SV2 is energized to actuate or shift the solenoid valve SV2 as described above in relation to FIG. 1A to retract the piston P1 and rod R1 of cylinder C1. Here, again, current flow through coil of SV2 switches relay RE2 from its first, normal conductive state as shown in FIG. 2B to a second state where terminals 5-3 are connected. In its second conductive state, relay RE2 provides a direct ground path for the current flowing through coil of SV2 so that pressure switches PS1,PS4 are bypassed until relay RE2 is reset when switch SW1 is moved to the "lock" position to interrupt current flow through the coil of SV2. As such, the relay RE2 ensures that opening of either switch PS1,PS4 will not interfere with coupling or decoupling operations once these operations are initiated.

The diode bridge BR1 is provided as a circuit protection device to prevent damage to the lamps L1,L2 and other circuit components, and also prevents current flow from switch SW2 to components located upstream from the bridge BR1.

In a typical de-coupling operation, an operator will move the associated attachment to the required de-coupling position such as full-curl or full-extend using a joystick or other control device. This, results in an "over-relief" pressure sufficient to close pressure switch PS4. If the operator maintains the joystick J or other control device in the fully displaced or other select position that resulted in movement of the attachment to the de-coupling position, the pressure in pilot path PP will close switch PS1. The operator then activates switch SW2 to energize the coil of solenoid valve SV3 and retract piston P2 and rod R2 to allow the second attachment locking mechanism to be opened so that a control link can be de-coupled and moved away from the attachment so as not to be inadvertently re-coupled. The operator then moves switch SW1 to the "unlock" position so that the coil of solenoid SV2 is energized to retract piston P1 and rod R1 of cylinder C1 to open a first lock associated therewith after the above-described delay/warning sequence is carried out. Once the lock controlled by the first cylinder C1 is opened, the arm or dipper stick of the machine is moved away from the attachment. It is noted that upon switch SW1 being moved to the "unlock" position, the lock associated with the cylinder C2 and machine control link will automatically re-engage, but the machine control link will have already been moved out of a coupling position by the operator so that re-coupling of the attachment to the control link will not occur.

Coupling operations are performed in the opposite sequence as will be readily apparent to those of ordinary skill in the art. In general, the cylinder C1 is first retracted via operation of switch SW1 to allow for coupling an attachment to the arm or dipper stick. The switch SW1 is then moved to "lock" so that the piston and rod P1,R1 of cylinder C1 are extended to capture the attachment to the arm or stick by way of an associated lock controlled by the cylinder C1. The switch SW2 is then actuated to retract piston and rod P2,R2 of cylinder C2 to allow the attachment to be coupled to a control link. Once the attachment is located as desired, the switch SW2 is opened so that the piston and rod P2,R2 extend to capture the attachment to the link by way of an associated locking mechanism controlled by cylinder C2.

Figure 2C:
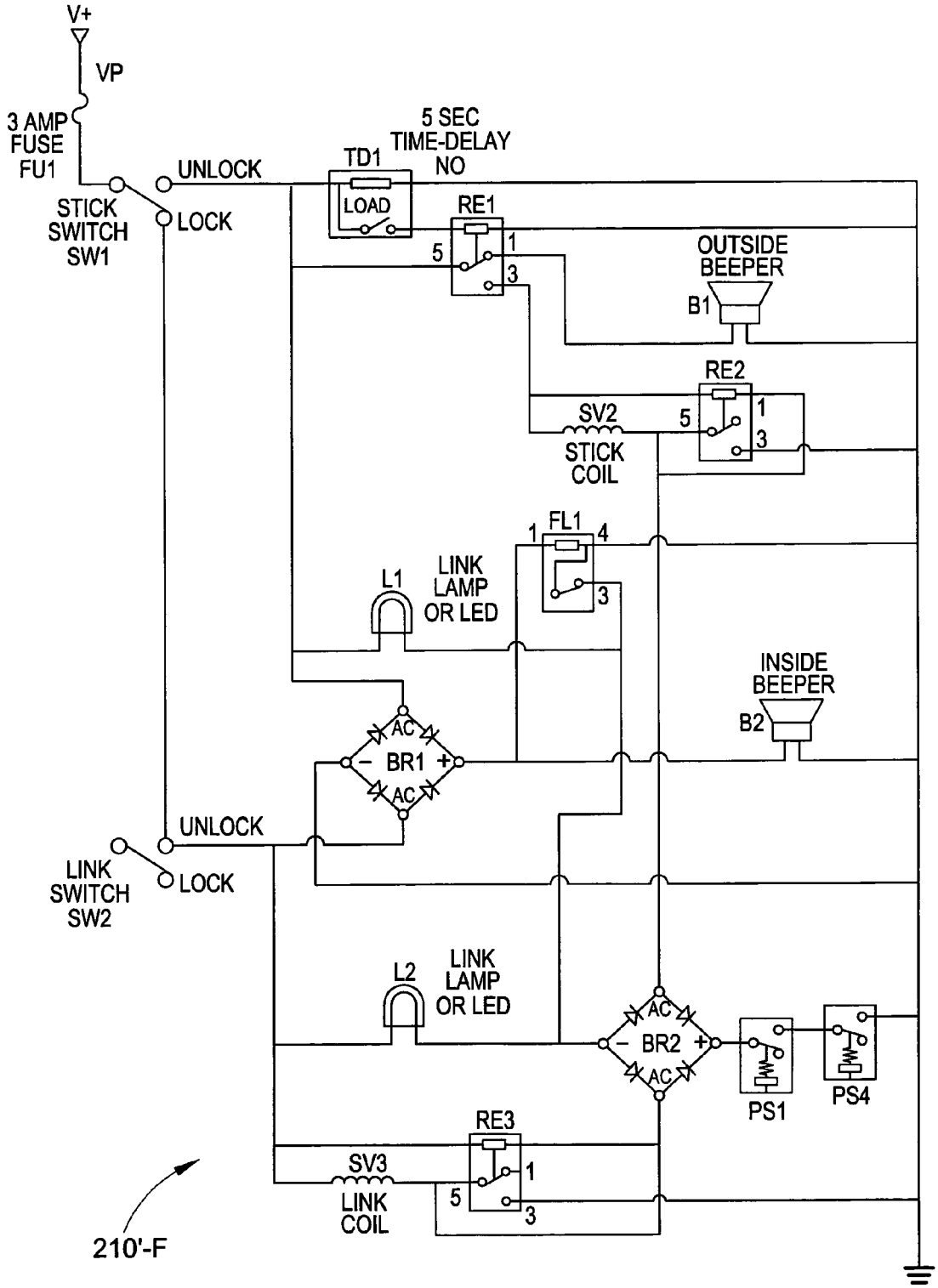
FIG. 2C is a schematic diagram of an alternative electrical circuit for controlling a two-actuator hydraulic circuit in accordance with the present invention.

With brief reference to FIG. 2C, a circuit 210'-F is illustrated. Except as shown and/or described, circuit 210'-F is structured and functions identically to circuit 210'. Unlike circuit 210', however, circuit 210'-F comprises a flasher FL1 that causes visual indicators L1,L2 to flash for a select period of time that can be varied when energized to ensure that an operator notices same. In one embodiment, the flasher is set to flash the visual indicators L1,L2 while actuators C1,C2 are performing unlocking (de-coupling) operations, and to maintain the visual indicators in a lighted condition thereafter when unlocking operations are completed, i.e., the timer within the flasher corresponds to the length of time for the actuators C1,C2 to cycle.

Figure 3A:
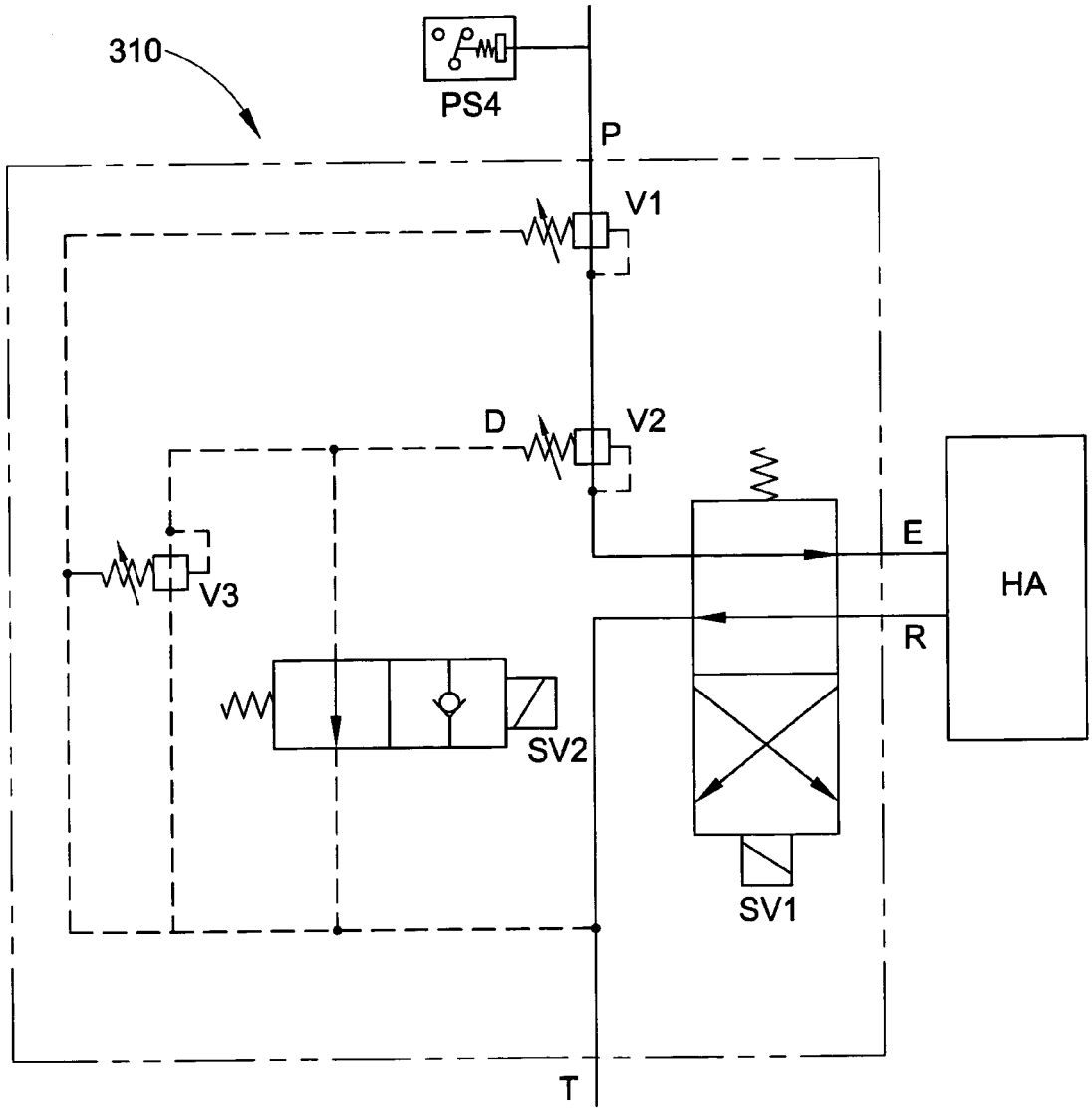
FIG. 3A is a schematic diagram of an alternative hydraulic circuit for controlling a single hydraulic actuator in accordance with the present invention.

FIG. 3A illustrates a hydraulic circuit 310 suitable for controlling a hydraulic actuator HA that can be, e.g., a hydraulic cylinder or a motor drivingly connected to a jackscrew assembly. The actuator HA can be used to control a lock of a quick coupler or can be used to expand the quick coupler from a first state for coupling/decoupling to a second state for fixedly securing an attachment to the arm/stick of an excavator or other machine. Circuit 310 comprises a hydraulic fluid input path P that receives flow from a pump and a hydraulic fluid return or output path T that flows to a reservoir. First and second pressure reducing valves V1,V2 serially reduce pressure in path P and are in communication with solenoid valve SV1. In its normal, deenergized state, solenoid valve SV1 provides simple flow-through for the path P to an "extend" path E that flows to the actuator HA to operate same in a first direction to actuate a locking or coupling mechanism controlled thereby. "Retract" path R from actuator HA flows through solenoid valve SV1 to the reservoir via path T. As shown, when coil of valve SV1 is energized, the valve SV1 is actuated so that the spool thereof is shifted to provide cross-flow so that input path P is communicated to "retract" path R and so that "extend" path E is communicated to the reservoir via path T. This, then reverses operation of the actuator HA to de-actuate the locking or coupling mechanism controlled thereby (a pilot check valve such as PCV1 is also preferably provided as described above but is not shown again here). It is possible, however, for the actuator HA to become stuck so that it resists de-actuation when valve SV1 is energized. Accordingly, circuit 310 includes a pressure boost feature to overcome this potential problem.

More particularly, a solenoid valve SV2 is provided in communication with a drain line D of pressure reducing valve V2. Valve SV2 normally allows relatively unrestricted flow of drain line D to the reservoir via path T. When valve SV2 is energized, it acts as a check valve to block flow of drain line D therethrough. As such, when valve SV2 is energized, drain line D can flow to path T and reservoir only through a pressure relief valve V3 when pressure in drain path D exceeds a select threshold. Therefore, when valve SV2 is energized, flow through drain line D is significantly restricted and, thus, the pressure drop across valve V2 is lessened or eliminated so that pressure in path P downstream from valve V2 (at valve SV1) is boosted.

Figure 3B:
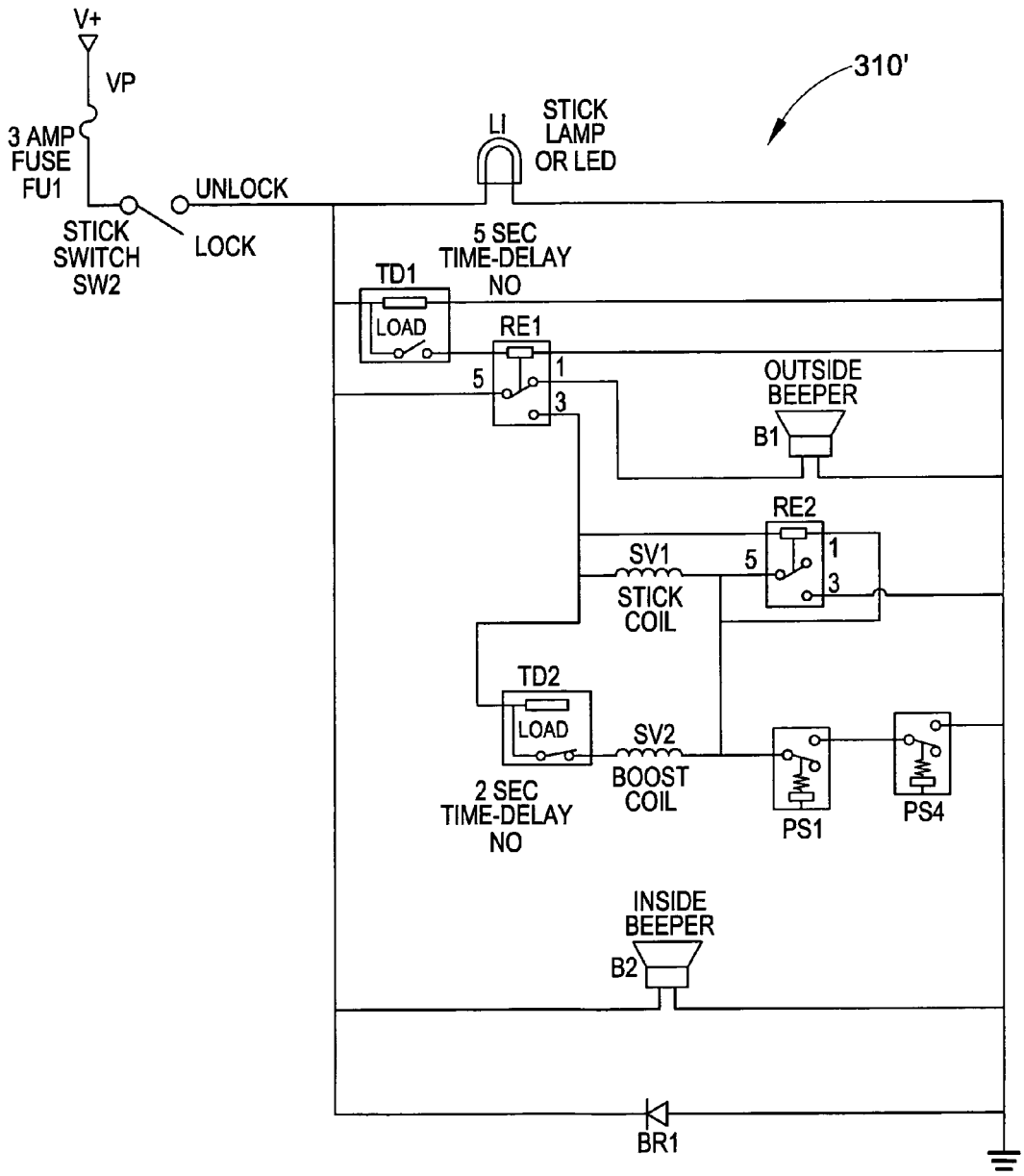
FIG. 3B is a schematic diagram of an electrical circuit for controlling the single-actuator hydraulic circuit shown in FIG. 3A in accordance with the present invention.

FIG. 3B illustrates an electrical circuit 310' for controlling the circuit 310 and, in particular, valve SV1 and SV2 thereof. A DC operating voltage V+is supplied to a switch SW2 located in the operator cab via voltage input path VP. The switch SW2 is a simple toggle switch or can be a more advanced switching system as described above in relation to FIG. 1B. When the switch SW2 is opened, the coils of the valves SV1,SV2 are de-energized owing to the open circuit relative to voltage source V+. When the switch SW2 is closed, current flows through an indicator lamp or LED or the like L1 located in the operator's cab so that the operator receives a visual indication that the switch SW2 is closed. Closing of the switch SW2 also results in current flow through an audible buzzer/beeper B2 located inside the operator's cab so that the operator receives an audible indication that the switch SW2 is closed.

When the switch SW2 is closed, current flows to a timer TD1 and through relay RE1 to a beeper/buzzer B1 located outside the operator's cab to warn workers and others that the switch SW2 is closed (i.e., that a de-coupling operation is being carried out).

After a select delay (e.g., 5 sec.) according to the parameters of timer TD1, the timer TD1 latches so that a switching current also flows to relay RE1 and causes relay to switch from a first conductive state (as shown with terminals 5-1 connected) to a second conductive state (in which terminals 5-3 are connected). In the second conductive state of relay RE1, the outside beeper B1 is de-energized. If, at the same time, the first and second hydraulic pressure switches PS4, PS1 are closed (i.e., conditions (i) and (ii) above are satisfied), the circuit between the voltage source V+ and ground is complete and the coil of solenoid valve SV1 is energized to actuate or shift the solenoid valve SV1 as described above in relation to FIG. 1A so that cross-flow is established in paths R,E causing reversal of actuator HA. At the same time, current flow through coil of solenoid valve SV2 provides a switching current to relay RE2 that causes relay RE2 to switch from a first (normal) conductive state, with terminals 5-1 connected, to a second conductive state, with terminals 5-3 connected. When the relay RE2 is in its second conductive state, the pressure switches PS4,PS1 are bypassed so that if either or both of these switches opens, the coil of valve SV2 remains energized via current flow through relay RE2 to ground for reasons as described above to allow an operator to maneuver the coupling device in an effort to couple to or decouple from an attachment without deenergization of valve SV1.

When coil of valve SV1 is energized, current also flows to coil of valve SV2 to energize same via second timer TD2. As such, valve SV2 is energized to provide the above-described hydraulic pressure boost in path P downstream from pressure reducing valve V2. After a select delay according to timer TD2, e.g., 2 seconds, timer TD2 opens the circuit upstream from coil of valve SV2 so that valve SV2 is deenergized and so that the pressure boost in circuit 310 is eliminated.

When the operator opens switch SW2, current flow through coil of valve SV1 ceases so that the valve SV1 returns to its normal state and so that relay RE2 resets.

Figure 3C:
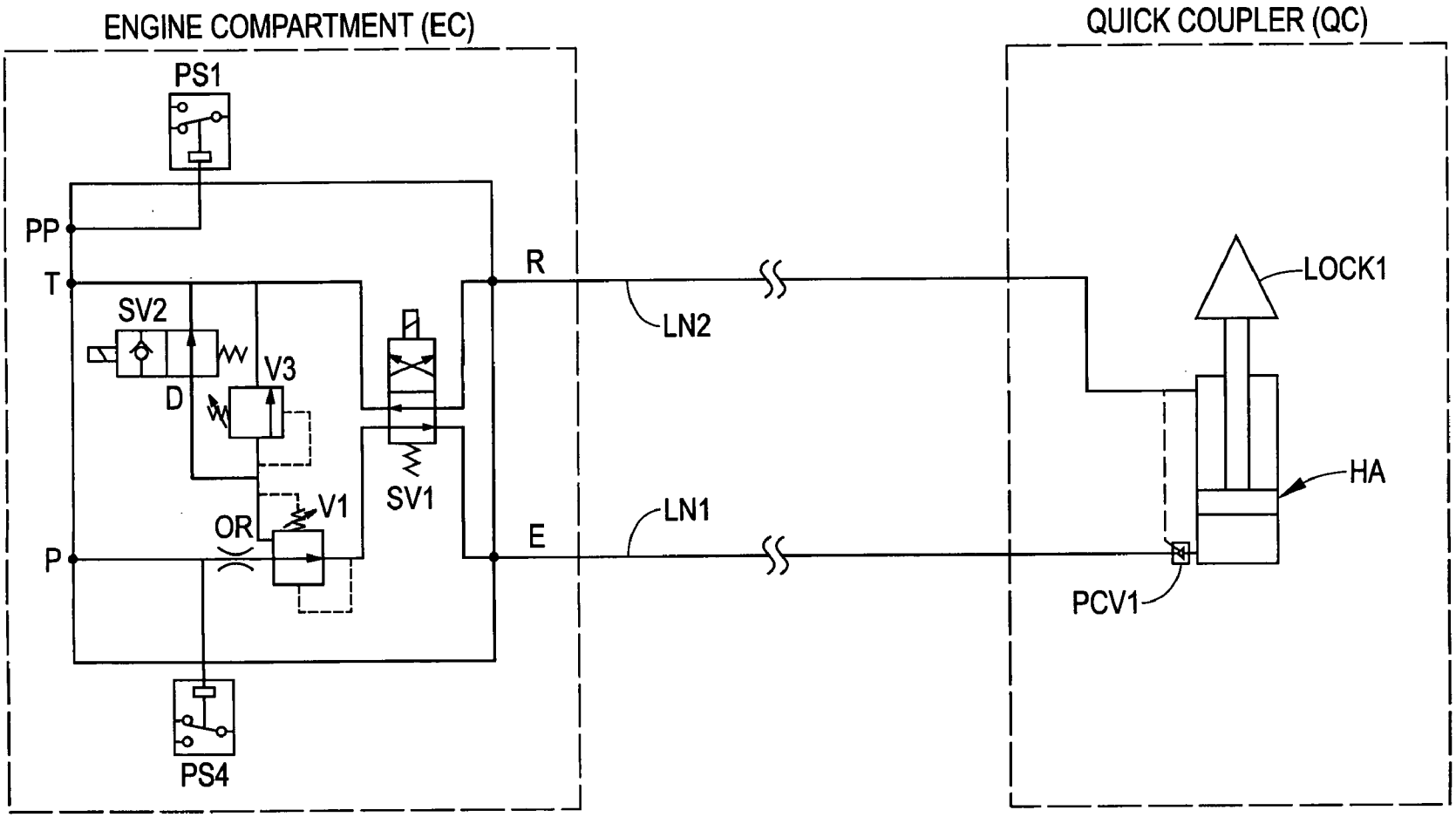
FIG. 3C illustrates an alternative hydraulic circuit including a boost feature.

FIG. 3C illustrates an alternative hydraulic circuit 410 including a boost feature similar to that described above with reference to the hydraulic circuit 310. The circuit 410 is used to control a hydraulic actuator HA that can be, e.g., a hydraulic cylinder or a motor drivingly connected to a jackscrew assembly. The actuator HA can be used to control a lock LOCK1 of a quick coupler QC or can be used to expand the quick coupler QC from a first state for coupling/decoupling to a second state for fixedly securing an attachment to the arm/stick of an excavator or other machine. Circuit 410 comprises a hydraulic fluid input path P that receives flow from a pump and a hydraulic fluid return or output path T that flows to a reservoir. An orifice OR reduces the fluid flow rate from a first rate (e.g., 10 gpm) to a second rate (e.g., 3 gpm). A pressure reducing valve V1 reduces pressure in path P upstream from solenoid valve SV1. In its normal, deenergized state, solenoid valve SV1 provides simple flow-through for the path P to an "extend" path E that flows to the actuator HA to operate same in a first direction. "Retract" path R from actuator HA flows through solenoid valve SV1 to the reservoir via path T. As shown, when coil of valve SV1 is energized, the valve SV1 is actuated so that the spool is shifted to provide cross-flow so that input path P is communicated to "retract" path R and so that "extend" path E is communicated to the reservoir via path T. This, then reverses operation of the actuator HA (a pilot check valve such as PCV1 is also preferably provided as described above but is not shown again here). The valve SV1 is operated as described above in relation to the circuit 310 insofar as the pressure switches PS1,PS4 are concerned.

Figure 4:
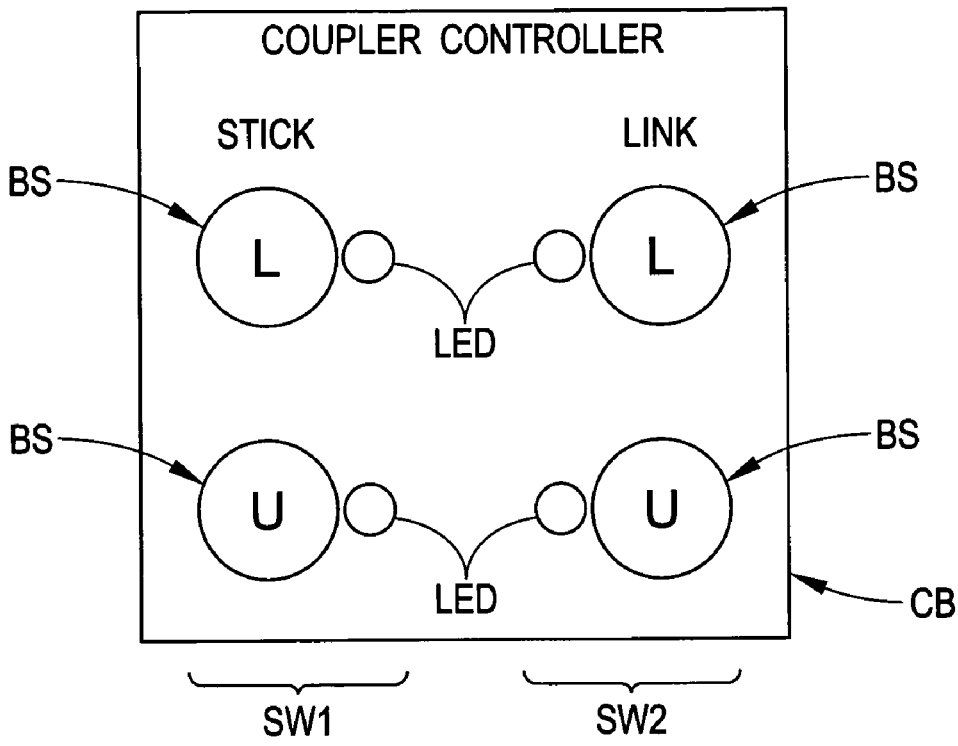
FIG. 4 diagrammatically illustrates an example of a control box for housing the electrical circuits of FIGS. 1C, 2B, 2C, 2D or 3B in accordance with the present invention.

As noted above, the actuator HA can sometimes become stuck so that it resists reverse movement when valve SV1 is energized. Accordingly, circuit 410 includes a pressure boost feature to overcome this potential problem. More particularly, a poppet valve SV2 is provided in communication with a drain line D of pressure reducing valve V1. Poppet valve SV2 normally allows flow of drain line D to the reservoir via path T. When poppet valve SV2 is actuated/energized, the spool thereof is shifted to a position where the poppet valve acts as a check valve to block flow of drain line D therethrough. As such, when poppet valve SV2 is energized, drain line D can flow to path T and reservoir only through a sequence valve V3 when pressure in drain path D exceeds a select threshold. Therefore, when poppet valve SV2 is energized, flow through drain line D is significantly restricted and, thus, the pressure drop across valve V1 is lessened or eliminated so that pressure in path P downstream from valve V1 (at valve SV1) is boosted. FIG. 4 illustrates an example of a control box CB for housing any of the electrical circuits described above. In the illustrated example, the switches SW1,SW2 are provided by "bubble" switches BS that must be depressed and maintained in the depressed state for at least one second to be actuated. LED's provide a visual indication as to when a bubble switch BS has been depressed properly for actuation. Of course, for the circuits 10' and 310', the control box CB would include only the switch SW2 and not the switch SW1 and would be labeled accordingly.

The audible buzzers/beepers B1,B2 can be provided by any suitable audible speaker device. In one preferred embodiment, the output of buzzers/beepers B1,B2 increases in volume as ambient noise increases and decreases as ambient noise decreases. Suitable buzzers/beepers are available from ECCO (www.eccolink.com) under various trademarks including SMART ALARM®.

While the preferred embodiments disclosed herein have been described primarily with reference to hydraulic cylinders, those of ordinary skill in the art will recognize that any other hydraulic actuator such as a motor, jackscrew or the like can be substituted for either or both of the cylinders C1,C2 without departing from the overall scope and intent of the present invention. It is not intended that the invention be limited for use with hydraulic cylinders or any other particular type of hydraulic actuator.

Of course, the electrical circuits and/or any portion of same described herein can also be implemented by solid-state devices and using micro controllers, software and/or other means to accomplish the functions described above. It is not intended that the invention be limited to the particular components shown herein. For example, the pressure sensing switches PS1,PS4 can each comprises a pressure sensor electrically connected to an electronic control circuit that output various control signals in response to the sensed pressure to control the flow of current through the coils of the various solenoid valves SV2,SV3 described above. The terms "switch" and "relay" are intended to encompass both mechanical switches and relays as well as electronic devices for selective conductivity of electrical current based upon manual input, in the case of switches, and electrical input, in the case of relays. Devices such as transistors and silicone controlled rectifiers (SCR's) are examples of devices that can be used as switches and relays within the scope of the present invention.

Figure 5:
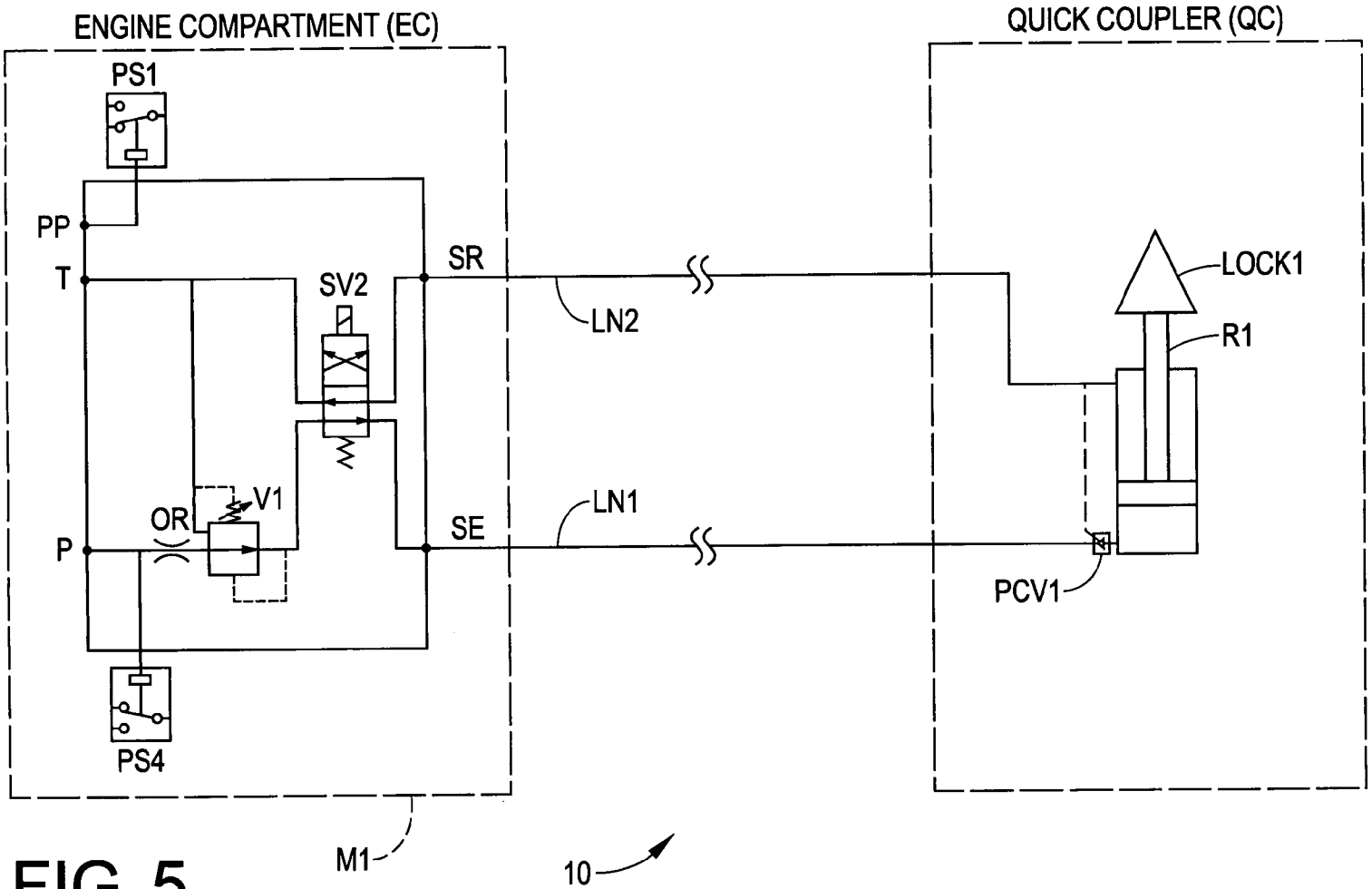
FIG. 5 shows an alternative implementation for the hydraulic circuit of FIG. 1A; and, FIG. 6 shows an alternative implementation of the hydraulic circuit of FIG. 2A.

As shown in FIG. 5, the hydraulic circuit 10 can be implemented using a manifold M1 located in the engine compartment EC of the excavator/backhoe/machine or can be otherwise spaced from the quick coupler QC, wherein the flow paths SR,SE comprise hydraulic lines LN1,LN2. Because pressure is reduced in the manifold M1 by the valve V1, the pressure rating of the hydraulic lines LN1,LN2 can be reduced to reduce cost. As is also shown in FIG. 5, manifold M1 of the circuit 10 comprises an orifice OR to control the fluid flow rate to obtain to desired flow, e.g., 3 gallons per minute (gpm).

Figure 6:
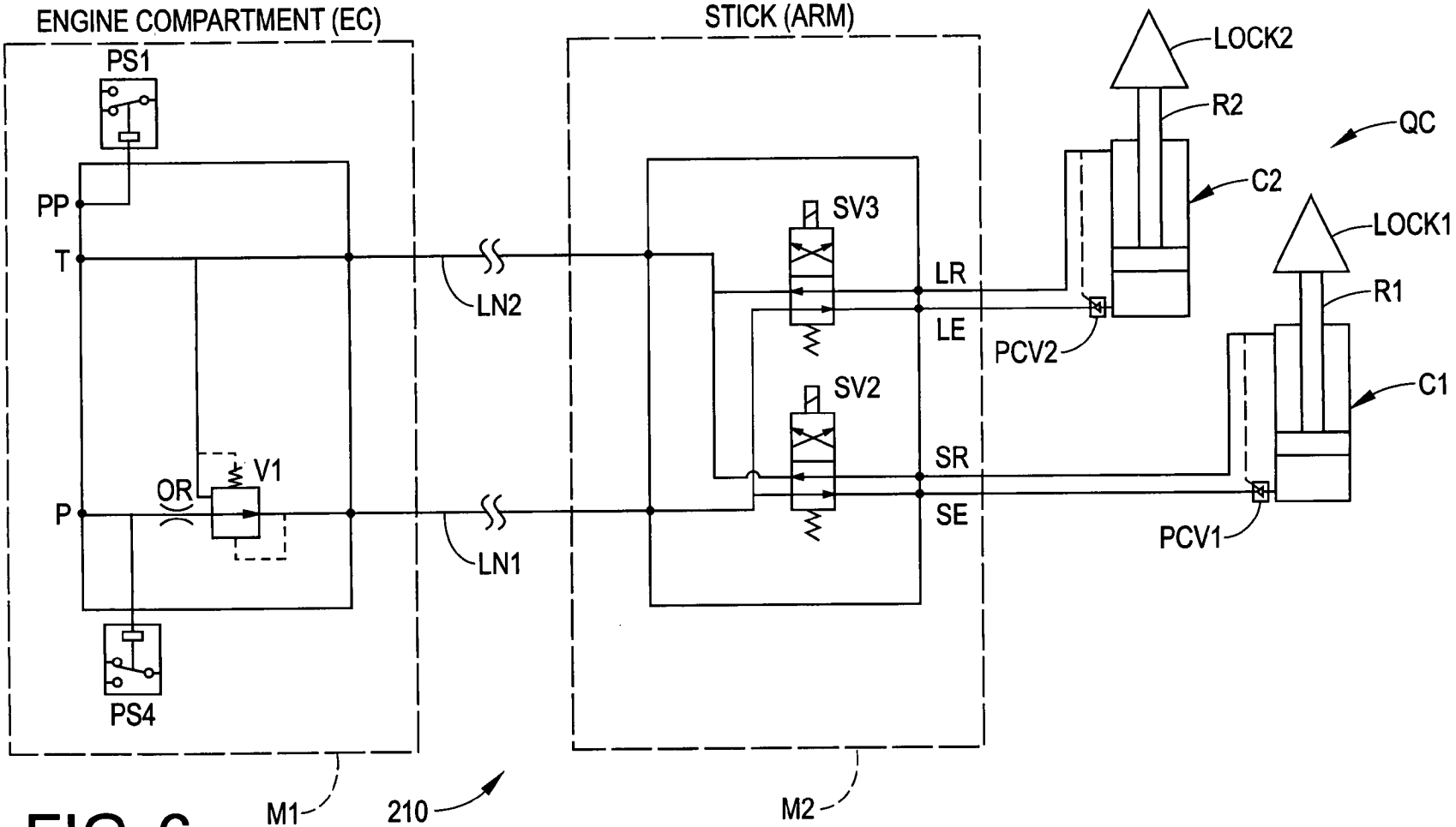

The hydraulic circuit 210 can be, implemented in a similar fashion as shown in FIG. 6. There, it can be seen that the circuit 210 comprises first and second manifolds M1,M2 that are separate and spaced apart. In one embodiment, the first manifold M1 is located in the engine compartment EC and the second manifold is connected to the machine stick adjacent the quick coupler QC. The manifold M1,M2 are fluidically interconnected by the hydraulic lines LN1,LN2 and, as noted above, these can have a reduced pressure rating because they are located on the lower pressure side of valve V1.

The invention has been described with reference the preferred embodiments. Modifications and alterations will occur to those of ordinary skill in the art, and it is intended that the invention be construed as including all such modifications and alterations.

The invention claimed is:

1. A hydraulic control circuit for an attachment coupling system, said control circuit comprising:

an input flow path for receiving a supply of pressurized fluid;

first and second actuator flow paths for supplying fluid to respective first and second input/output locations of a first hydraulic actuator;

a return flow path for supplying pressurized fluid to a reservoir;

a pilot pressure path adapted for connection to an associated attachment positioning device that outputs a varying pilot pressure of said pressurized fluid from said input flow path to said pilot pressure path in response to operator input;

a first control valve connected to said input flow path, said return flow path, and said first and second actuator flow paths, said first control valve selectively positionable in at least first and second states in response to first electrical input wherein: (i) in said first state, said first control valve connects said input flow path to said first actuator flow path and connects said return flow path to said second actuator flow path; and, (ii) in said second state, said first control valve connects said input flow path to said second actuator flow path and connects said return flow path to said first actuator flow path;

a first pressure sensor for sensing fluid pressure in said input path meeting or exceeding a first threshold;

a second pressure sensor for sensing fluid pressure in said pilot pressure path meeting or exceeding a second threshold;

wherein said first and second pressure sensors control said first electrical input to said first control valve to prevent a change of state of said first control valve depending upon fluid pressure in said input path and said pilot pressure path, respectively.

2. The hydraulic control circuit as set forth in claim 1, wherein said first hydraulic actuator comprises a hydraulic cylinder or a hydraulic motor.

3. The hydraulic control circuit as set forth in claim 2, wherein said first hydraulic actuator is operatively connected to a first locking mechanism of an attachment coupling system.

4. The hydraulic control circuit as set forth in claim 1, wherein said first control valve comprises a first solenoid valve comprising a first electrical coil.

5. The hydraulic control circuit as set forth in claim 4, wherein said first and second pressure sensors comprise respective first and second pressure sensing switches that complete a circuit between a voltage input path and an electrical ground path and including said first electrical coil of said first solenoid valve when activated.

6. The hydraulic control circuit as set forth in claim 1, further comprising a first pilot check valve connected to both said first and second actuator flow paths, wherein:

(i) said pilot check valve normally blocks fluid flow from said first actuator flow path into said return flow path; and, (ii) said pilot check valve is selectively opened to permit fluid flow from said first actuator flow path into said return flow path only when fluid pressure in said second actuator flow path meet or exceeds a pilot check threshold.

7. The hydraulic control circuit as set forth in claim 1, further comprising a pressure control valve located in said input path upstream from said first control valve.

8. The hydraulic control circuit as set forth in claim 7, further comprising a boost valve for selective actuation, wherein said boost valve, when actuated, adjusts said pressure control valve to increase pressure downstream from said pressure control valve.

9. The hydraulic control circuit as set forth in claim 1, further comprising:

third and fourth actuator flow paths for supplying fluid to respective first and second input/output locations of a second hydraulic actuator;

a second control valve connected to said input flow path, said return flow path, and said third and fourth actuator flow paths, said second control valve selectively positionable in at least first and second states in response to second electrical input wherein: (i) in its first state, said second control valve connects said input flow path to said third actuator flow path and connects said return flow path to said fourth actuator flow path; and, (ii) in its second state, said second control valve connects said input flow path to said fourth actuator flow path and connects said return flow path to said third actuator flow path;

wherein said first and second pressure sensors control said second electrical input to said second control valve to prevent a change of state of said second control valve depending upon fluid pressure in said input path and said pilot pressure path, respectively.

10. The hydraulic control circuit as set forth in claim 9, wherein said second hydraulic actuator comprises a hydraulic cylinder or a hydraulic motor.

11. The hydraulic control circuit as set forth in claim 10, wherein said second hydraulic actuator is operatively connected to a second locking mechanism of said attachment coupling system.

12. The hydraulic control circuit as set forth in claim 9, wherein said second control valve comprises a second solenoid valve comprising a second electrical coil.

13. The hydraulic control circuit as set forth in claim 12, wherein said first and second pressure sensors comprises respective first and second pressure sensing switches that complete a circuit between said voltage input path and an electrical ground path and including said second electrical coil of said second solenoid valve when activated.

14. The hydraulic control circuit as set forth in claim 9, further comprising a second pilot check valve connected to both said third and fourth actuator flow paths, wherein:

(i) said second pilot check valve normally blocks fluid flow from said third actuator flow path into said return flow path; and, (ii) said second pilot check valve is selectively opened to permit fluid flow from said third actuator flow path into said return flow path only when fluid pressure in said fourth actuator flow path meets or exceeds said pilot check threshold.

15. A control system for an attachment coupling system, said control system comprising:

an electrical control system comprising: (i) a voltage input path; (ii) first and second pressure sensors; and, (iii) an electrical ground path;

a hydraulic control system, wherein said hydraulic control system comprises:

an input flow path for receiving a supply of pressurized fluid;

first and second actuator flow paths for supplying fluid to respective first and second input/output locations of a first hydraulic actuator;

a return flow path for supplying pressurized fluid to a reservoir;

a pilot pressure path adapted to be connected to an attachment positioning device that outputs a varying pilot pressure of said pressurized fluid from said input flow path to said pilot pressure path in response to operator input;

a first control valve connected to said input flow path, said return flow path, and said first and second actuator flow paths, said first control valve selectively positionable in at least first and second states in response to first electrical input received from said electrical control system wherein: (i) in said first state, said first control valve connects said input flow path to said first actuator flow path and connects said return flow path to said second actuator flow path; and, (ii) in said second state, said first control valve connects said input flow path to said second actuator flow path and connects said return flow path to said first actuator flow path;

wherein:

said first pressure sensor senses pressure in said input flow path meeting or exceeding a first threshold;

said second pressure sensor senses pressure in said pilot pressure path meeting or exceeding a second threshold; and, said first and second pressure sensors control transmission of said first electrical input from said electrical control system to said first control valve to prevent a change of state of said first control valve depending upon fluid pressure in said input path and said pilot pressure path, respectively.

16. The control system as set forth in claim 15, wherein said electrical control system further comprises:

a first lock switch located in said voltage input path and selectively operable between a lock setting where it interrupts said voltage input path and an unlock setting where it defines a conductive portion of said voltage input path.

17. The control system as set forth in claim 16, further comprising a light and a first audible warning device connected to said voltage input path and operable to emit light and sound, respectively, when said first lock switch is in its unlock setting.

18. The control system as set forth in claim 16, wherein said first control valve comprises a first solenoid valve comprising a first coil to receive said first electrical input.

19. The control system as set forth in claim 18, further comprising a timer connected to said voltage input path between said first lock switch and said first coil, wherein said timer delays electrical connection of said first coil to said voltage input path when said first lock switch is set in its unlock setting.

20. The control system as set forth in claim 19, further comprising a first relay connected to said voltage input path and said timer, wherein said first relay disconnects said first audible warning device from said voltage input path when said timer completes a circuit between said first coil and said voltage input path.

21. The control system as set forth in claim 17, further comprising a second audible warning device connected to said voltage input path.

22. The control system as set forth in claim 18, wherein said first and second pressure sensors comprises respective first and second switches located in series with said first coil, wherein:

(i) said first pressure sensing switch breaks a circuit between said first coil and said electrical ground path when said pressure in said input flow path is below said first threshold; and, (ii) said second pressure sensing switch breaks a circuit between said first coil and said electrical ground path when said pressure in said pilot pressure path is below said second threshold.

23. The control system as set forth in claim 22, further comprising a second relay that is activated in response to current flow through said first coil, wherein said second relay, when activated, bypasses said first and second pressure sensing switches to complete a circuit between said first coil and said electrical ground.

24. The control system as set forth in claim 16, wherein said hydraulic control system further comprises:

third and fourth actuator flow paths for supplying fluid to respective first and second input/output locations of a second hydraulic actuator;

a second control valve connected to said input flow path, said return flow path, and said third and fourth actuator flow paths, said second control valve selectively positionable in at least first and second states in response to second electrical input wherein: (i) in its first state, said second control valve connects said input flow path to said third actuator flow path and connects said return flow path to said fourth actuator flow path; and, (ii) in its second state, said second control valve connects said input flow path to said fourth actuator flow path and connects said return flow path to said third actuator flow path;

wherein said first and second pressure sensors control transmission of said second electrical input to said second control valve to prevent a change of state of said second control valve depending upon fluid pressure in said input path and said pilot pressure path, respectively.

25. The control system as set forth in claim 24, wherein said second control valve comprises a second solenoid valve comprising a second coil to receive said second electrical input.

26. The control system as set forth in claim 25, wherein said first and second pressure sensing sensors comprise respective first and second switches located in series with said second coil, wherein:

(i) said first pressure sensing switch breaks a circuit between said second coil and said electrical ground path when said pressure in said input flow path is below said first threshold; and, (ii) said second pressure sensing switch breaks a circuit between said second coil and said electrical ground path when said pressure in said pilot pressure path is below said second threshold.

27. The control system as set forth in claim 26, further comprising a third relay that is activated in response to current flow through said second coil, wherein said third relay, when activated, bypasses said first and second pressure sensing switches to complete a circuit between said second coil and said electrical ground.

28. The control system as set forth in claim 27, wherein said electrical control switch further comprises:

a second lock switch connected to said voltage input path only when said first lock switch is in said lock setting, wherein said second lock switch selectively completes a circuit between said voltage input path and said second coil.

29. A hydraulic control circuit for an attachment coupling system, said control circuit comprising:

an input flow path for receiving a supply of pressurized fluid;

first and second actuator flow paths for supplying fluid to respective first and second input/output locations of a first hydraulic actuator;

a return flow path for supplying pressurized fluid to a reservoir;

a pilot pressure path adapted for connection to an associated attachment positioning device that outputs a varying pilot pressure of said pressurized fluid from said input flow path to said pilot pressure path in response to operator input;

a first control valve connected to said input flow path, said return flow path, and said first and second actuator flow paths, said first control valve selectively positionable in at least first and second states in response to first electrical input wherein: (i) in said first state, said first control valve connects said input flow path to said first actuator flow path and connects said return flow path to said second actuator flow path; and, (ii) in said second state, said first control valve connects said input flow path to said second actuator flow path and connects said return flow path to said first actuator flow path;

means for selectively preventing a change of state of said first control valve when fluid pressure in both said input path and said pilot pressure path is below a select threshold.

30. A hydraulic control circuit for an attachment coupling system, said control circuit comprising:

an input flow path for receiving a supply of pressurized fluid;

first and second actuator flow paths for supplying fluid to respective first and second input/output locations of a first hydraulic actuator;

a return flow path for supplying pressurized fluid to a reservoir;

a pilot pressure path adapted for connection to an associated attachment positioning device that outputs a varying pilot pressure of said pressurized fluid from said input flow path to said pilot pressure path in response to operator input;

a first control valve connected to said input flow path, said return flow path, and said first and second actuator flow paths, said first control valve selectively actuable from a first state to a second state in response to first electrical input wherein: (i) in said first state, said first control valve connects said input flow path to said first actuator flow path and connects said return flow path to said second actuator flow path; and, (ii) in said second state, said first control valve connects said input flow path to said second actuator flow path and connects said return flow path to said first actuator flow path; and, an electrical pressure switch that measures fluid pressure in said input flow path, wherein said first electrical input to said first control valve is interrupted by said electrical pressure switch to prevent actuation of said first control valve from said first state to said second state when said fluid pressure in of said input flow path does not satisfy a select pressure condition.

31. A method for controlling an attachment coupling system, said method comprising:

pressurizing a locking mechanism with hydraulic fluid in a first orientation to lock an attachment locking mechanism; and, pressurizing said locking mechanism with hydraulic fluid in a second orientation to unlock an attachment locking mechanism, wherein said step of pressurizing said locking mechanism with hydraulic fluid in a second orientation is performed only after at least two separate hydraulic pressure threshold conditions have been satisfied.

* * * * *